US006811055B2

(12) United States Patent
Polesuk

(10) Patent No.: US 6,811,055 B2
(45) Date of Patent: Nov. 2, 2004

(54) READY TO USE HAIRCOLORING FOIL

(75) Inventor: Eric Polesuk, Randolph, NJ (US)

(73) Assignee: Product Club Corp., Rockaway, NJ (US)

( * ) Notice: Subject to any disclaimer, the term of this patent is extended or adjusted under 35 U.S.C. 154(b) by 0 days.

(21) Appl. No.: 10/755,155

(22) Filed: Jan. 12, 2004

(65) Prior Publication Data

US 2004/0140316 A1 Jul. 22, 2004

Related U.S. Application Data

(62) Division of application No. 10/072,528, filed on Feb. 8, 2002.

(51) Int. Cl.[7] ..... A47K 10/24

(52) U.S. Cl. ..... 221/45; 206/494

(58) Field of Search ..... 221/45, 44, 63, 221/307, 48, 46; 206/494, 449, 812

(56) References Cited

U.S. PATENT DOCUMENTS 5,897,023 A * 4/1999 Lee ..... 221/48
6,299,017 B1 * 10/2001 Hill ..... 221/63

* cited by examiner

*Primary Examiner*—Kenneth Noland
(74) *Attorney, Agent, or Firm*—Philip M. Weiss; Weiss & Weiss

(57) ABSTRACT

Ready to use sheets of aluminum foil sized specifically for salon use and dispensed in an engineered delivery system that allows for rapid fingertip use.

7 Claims, 1 Drawing Sheet

READY TO USE HAIRCOLORING FOIL

This application is a division of 10/072,528 filed Feb. 8, 2002.

FIELD OF THE INVENTION

Ready to use sheets of aluminum foil sized specifically for salon use and dispensed in an engineered delivery system that allows for rapid fingertip use.

BACKGROUND OF THE INVENTION

Aluminum foil is widely used in the Professional Beauty Industry on both woman and men of all ages during the application of haircolor. The foil itself is used to isolate specific strands of hair so that a specific shade of haircolor can be applied to those strands without affecting the other strands nearby. This approach allows a particular effect or "look" to be created in a client's hair.

This process of haircoloring sometimes referred to as highlighting, lowlighting, tinting, streaking, or weaving works as follows: 1) strands of hair are placed on a of piece of foil, 2) haircolor and developers are then placed on these strands usually with an applicator brush, 3) the foil is then folded up toward the scalp, 4) the sides of the foil are then folded inward creating a packet or "wrap" that completely isolates these strands of hair from all others. This process continues and can involve as many as 100 pieces of foil per application. Since this process is very tedious and repetitive it is helpful to have at the point of application, foil that is already cut to the ideal size and the exact amount to complete the application. Because this application is very technical, it is almost always done in a professional salon environment by colorists who are skilled in the trade.

Since only a few strands of hair are wrapped with each piece of foil, a common trend in the Beauty Industry is to work with a foil sheet that is between 3.5 and 6 inches in width. This narrow width allows for wrapping of small sections of hair, which is desired.

Prior to the present invention, salons had no choice but to use foil that was intended for consumer and industrial/institutional uses such as cooking, storing, and general usage. Although economical and readily available in roll format at supermarkets, foodservice distributors, and paper supply companies, this type of foil was entirely too big for use in haircoloring applications without further preparation. As a result, salons waste hours of valuable time each day cutting and tearing foil into useable and manageable sizes for use in haircoloring applications. Enough foil had to be prepared for each application to each client.

To improve their situation and get away from the constant cutting of large industrial rolls of foil (usually 12 to 18 inches in width and 25 to 1000 feet in length), many salons gravitated towards interfolded aluminum foil sheets, commonly referred to in the foodservice industry as "pop up foil". Since this product was designed for constant repetitive wrapping of small food products, such as baked potatoes or sandwiches, it was commercially available in 2 sizes, (9"×10.75" or 12"×10.75") both in a very light weight foil gauge. This ensured complete coverage of a particular food product. The smaller of the two sheet sizes became most prevalent in the Beauty Industry for reasons stated below.

Since the interfolded foil offered a fold or "crease" in the center (part of the interfolding process) salons could easily tear the foil sheet in half along the crease. Once cut in half, the sheet size became approximately 5.375 inches wide and 10.75 inches long, a useable and much more manageable width for salons, that required no other alterations.

The foodservice interfolded sheets became available in piles or stacks that contained either 200 or 500 sheets per dispenser box. Because the entire stack of sheets was interfolded together, each time a sheet was pulled out from the box or dispensed, the next subsequent sheet was already partially sticking out of the box, ready to be easily grabbed by the user; similar to facial tissues. By the virtue of interfolding the sheets together, the desired pop up/pop out effect was achieved making grabbing and securing the next piece of foil easier versus having to grab and separate a piece of foil from a pile that is just stacked one on top of the other (current method).

Although interfolded sheets manufactured for foodservice use made preparing hair foils easier versus the cutting up of large industrial rolls, salons still had to spend hours tearing foils in half and were still left to work with a product that was not specifically designed for their application. Further, due to the foodservice foil being a very light gauge, and the quick hurried approach taken by those cutting the foil, a straight precise cut was not always achieved. Therefore, this tearing method resulted in a fair amount of undesired foil that was wasted and had to be discarded.

The preparation (cutting and/or tearing) of these interfolded foils occurred in advance, "behind the scenes", away from the client as a colorist would not have the time to easily perform three actions while holding an applicator brush and working on their client; 1) dispense a large food foil sheet, 2) tear the sheet in half, 3) apply the foil and color products to the hair. In this manner, the colorist would have to set the applicator brush down each time he/she wanted to tear a piece of foil in half and then pick it up again to apply the hair color. Since upwards of 100 hundred foils are applied to a single client, this becomes a very unproductive situation. Even if this unproductive approach is taken, there would be insufficient room at the workstation (typically a 10"×15" surface area) to house a foodservice dispenser box that was 9 inches wide as the workstation is limited in size and filled with many other necessities including multiple color bowls, brushes, hair color tubes, an application timer, etc.

Once torn in half "behind the scenes", the interfolded foil would be brought to the workstation and stacked into a manageable pile for use in the haircoloring process. This pile of foil became easily disorganized due to the many hindrances at the work area, and often blew off the workstation by the breeze created from someone walking by or even a blow dryer used at a nearby workstation. This presented a sloppy and unprofessional image in most color departments.

Further, the preparation of foils was done "behind the scenes" so that the client would not be exposed to the fact that salons were using foil designed and packaged for food on their client's head. In this manner, the professionalism and longevity of the Beauty Industry can be preserved, as clients would perceive that this was strictly a professional application that could not be achieved on their own, at home, using foodservice/kitchen foil.

Although interfolded sheets of aluminum foil offered by foodservice companies for food applications are now commercially available in widths ranging from 7 to 12 inches, (depending upon the particular manufacturer), a width less than 7 inches, sized specially for salon use, and ready to use without further preparation, has not commercially existed until this invention.

U.S. Pat. No. 5,897,023 relates to a dispensing carton for tissues, aluminum foils, plastic wraps or the like which has a top portion which includes an elongated opening for withdrawing tissues from the carton. The dispensing carton includes a plurality of strings having first and second ends. The plurality of strings is configured to form a slit for holding the tissues to prevent dropping into the carton.

Disposable facial tissues are conventionally contained in a substantially rectangular carton having an elongated opening in the top surface. The carton contains a stack of interfolded tissues arranged such that they can be dispersed through the opening of the carton. The embodiments of the invention may be used with those materials sold in a roll form, such as aluminum foil, plastic wrap or the like, rather than individual sheets interfolded together.

U.S. Pat. No. 6,299,017 relates to a dispensing face for a dispensing unit comprising at least one stack of laminar articles wherein the dispensing face is continuous, comprises lateral outer edges and longitudinal outer edges and not less than two orifices.

The prior art describes the sequential or pop-up dispensers. In a pop-up dispensing unit, a tissue extends through the dispensing orifice to an elevation above that of the dispensing unit. The consumer simply grasps the exposed portion of the tissue, without the necessity of inserting fingers through the dispensing orifice. In pop-up dispensing, each tissue has a lead portion that passes through the dispensing orifice, and a trailing portion that later passes through the dispensing orifice. Typically, the trailing portion of a first tissue to be dispensed overlaps the leading portion of the next tissue to be dispensed. The overlap is generally measured parallel to the direction of withdrawal of the tissues through the dispensing orifice. The overlap is usually, but not necessarily, the same for each tissue and constant throughout the width of each tissue. As the consumer withdraws the first tissue, the leading portion of the next tissue is pulled through the orifice for later dispensing.

The sequential withdrawal of the succeeding tissue through the dispensing orifice occurs due to the interfolding of adjacent tissues. The tissues are folded against one another in a variety of configurations, so that the friction of the trailing portion of the withdrawn sheet against the succeeding sheet pulls the leading portion of the succeeding sheet through the dispensing orifice.

U.S. Pat. No. 6,053,357 relates to an upright, or pop-up, box dispenser having a curvilinear opening for dispensing thin sheets of paper such as tissues or non-woven products. The curvilinear opening may be in the shape of an "S", multiple "S" shapes or arcs. The invention allows for interfolded single sheets to be dispensed without tearing, while maintaining these sheets in an aesthetic pop-up presentation and protecting the sheets that remain in the box.

U.S. Pat. No. 5,622,281 relates to a dispenser for folded sheets and bulk packets. The invention provides a folded sheet dispenser with a vertical end opening extending into the top with an internal control plate which controls the one at a time consecutive removal of folded sheets.

U.S. Pat. No. 6,182,418 relates to a method and apparatus for packaging tissue into a pop-up dispenser. The pop-up dispenser being a carton having a top wall, a bottom wall and four sidewalls that join the top wall to the bottom wall. The carton also has an opening formed in the top wall through which the tissues can be withdrawn. The method includes the steps of providing several tissues that are substantially identical to one another. The tissues are described as a first tissue and a plurality of other tissues. The several tissues are transported to a folding station and are interfolded to form an interfolded assemblage. The first tissue is colored or has a visual indicator printed or applied to it to form a visually distinctive tissue. The interfolded assemblage is then cut to form a plurality of clips of interfolded tissues.

U.S. Pat. No. 5,740,913 relates to a pop-up tissue dispenser. In one embodiment, a visually distinctive tissue has primary and secondary folds and a visual indicator disposed adjacent the secondary fold. In another embodiment, the visually distinctive tissue and the other tissues form a color interface that is visible through the carton opening prior to the removal of any tissues from the carton.

SUMMARY OF THE INVENTION

The present invention solves the major flaws found in all the aluminum foil products used for professional haircoloring up until this point.

The present invention relates to a hair foil sheet ranging in width from about 3.5 to 6 inches. It is an object of the present invention for the hair foil sheet to have a weight or gauge ranging from about 0.00035 to 0.001 inches in thickness with a preferred weight or gauge ranging from 0.0005 to 0.0007 inches thick. It is an object of the present invention for the hair foil sheet to be embossed. It is an object of the present invention for the hair foil sheet to be non-embossed. It is an object of the present invention for the hairfoil sheets to be interfolded.

The present invention relates to a system for dispensing hair foil sheets comprising; a pop up/out dispenser having interfolded sheets placed in the dispenser. The interfolded sheets have a width ranging from about 3.5 to 6.0 inches.

It is an object of the present invention for the hair foil sheet to be any color foil.

It is an object of the present invention for the hair foil sheet to comprise any and all types of alloys.

It is an object of the present invention to provide a ready to use haircoloring foil that is ready to use upon dispensing and requires no cutting, tearing, or preparing, thus eliminating hours of preparation time each day. It is an object of the present invention to provide a hair coloring foil that is sized specifically for salon use and has no other secondary or tertiary application. It is an object of the present invention to provide a hair coloring foil that offers the ideal weight, softness, and texture that salons prefer in a hair coloring foil. It is an object of the present invention for the hair coloring foil to be dispensed in a convenient pop up/pop out dispenser that allows for rapid fingertip use. It is an object of the present invention for the hair coloring foil to be quickly dispensed with one hand and applied to the hair in one single motion without the need to perform multiple steps to achieve the same results.

Due to its convenience, size, and professional image, the foil of the present invention can be brought out from "behind the scenes" and used at the workstation. It is an object of the present invention for the dispenser box to be about 3.5 to 6 inches. It is an object of the present invention for the width of the dispenser to fit much more conveniently at the workstation versus a 9-inch wide foodservice box It is an object of the present invention to provide for a means to store the product when its not being used.

It is an object of the present invention for the dispensing unit to be portable, lightweight, rigid container, semi-rigid container, flexible container, flexible box, or any combination.

The foil of the present invention is releasably attached to each other. Each foil is releasably attached to both adjacent foils by any releasable attachment means, which allows easy separation to occur as the foil is being dispensed. The releasable attachment means may comprise means such as adhesion, friction, cohesion, or other forces, which releasably attach adjacent foils.

The present invention relates to a method of putting hair foil in a person's hair. A user removes a first sheet of hair foil from a pop-up dispenser. The sheet of hair foil has a leading portion and a trailing portion. The lead portion of the sheet of hair foil extends through a dispensing orifice to an elevation above that of the dispensing unit. The trailing portion of the first hair foil overlaps with a lead portion of the next hair foil to be dispensed. By pulling the first sheet of hair foil through the orifice, the next hair foil sheet pops up through the orifice. The first hair foil sheet is applied to a person's hair.

DESCRIPTION OF THE PREFERRED EMBODIMENTS

Figure 1:
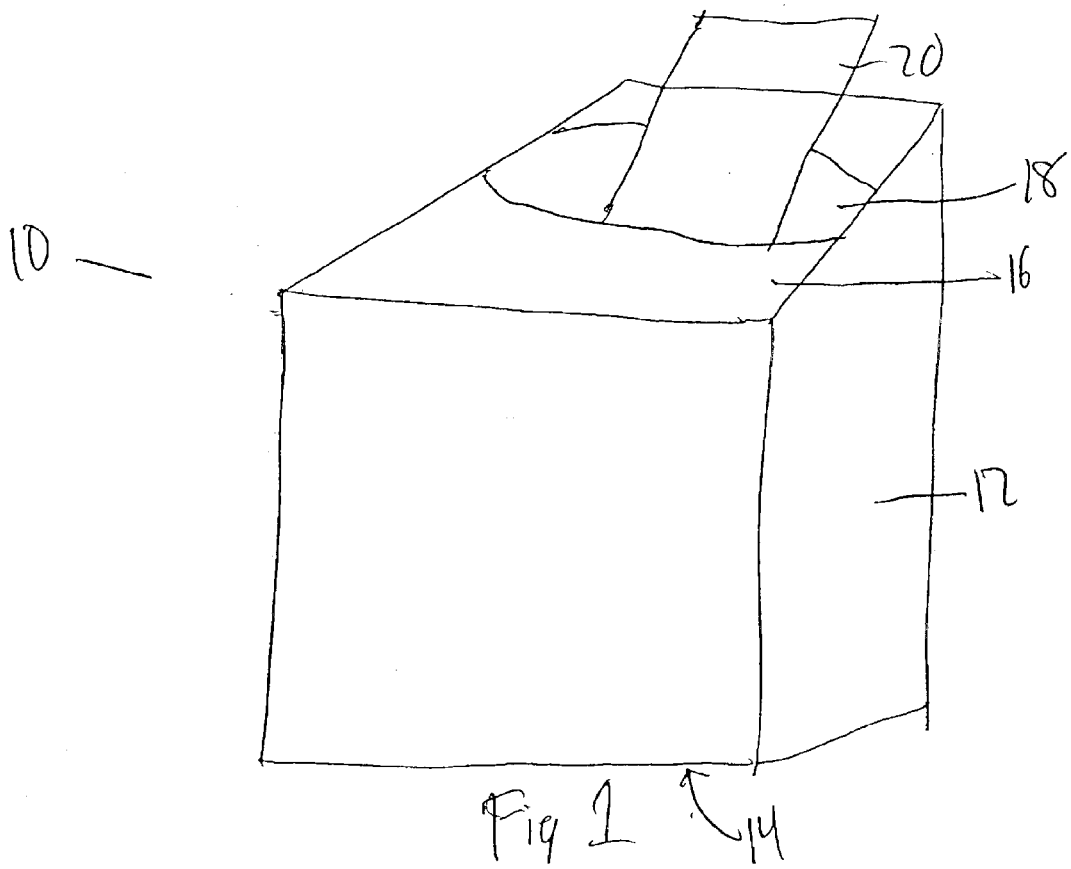
FIG. 1 is a front view of a dispenser of the present invention.

The present invention relates to a hair foil having a width of about 3.5" to 6.0". The foil has a weight or gauge ranging from about 0.00035 to 0.001 inches in thickness and preferably about 0.0005 to 0.0007 inches. The foil can be embossed or non-embossed. In an embodiment, the hair foil sheets are interfolded and presented in a pop up/out dispenser. The dispenser of the present invention can comfortably fit at a workstation. The hair foil can be of any color. The hair foil can be made of any or all alloys of foil.

In one embodiment the foil sheet is approximately 5"×11" and requires no cutting, folding or tearing. The sheets are placed in a pop-up dispenser that fits at any workstation. The dispenser neatly organizes the foils and allows a user to dispense the foil with one hand. In a preferred embodiment, the foil has an embossed pattern. This prevents the foil from slipping out of the hair. In a preferred embodiment, the foil has a pre-folded center that allows the foils to be easily folded and wrapped.

In one embodiment, the dispenser can hold at least 500 ready to use foil sheets. FIG. 1 illustrates an embodiment of a dispenser of the present invention. Dispenser 10 is made of four sidewalls 12, a bottom wall 14 and a top wall 16. The top wall 16 has an opening 18 through which foil sheets 20 can be withdrawn. In a preferred embodiment, the foils sheets 20 are interfolded.

In a preferred embodiment, in a pop-up dispensing unit of the present invention, a hair foil sheet extends through the dispensing orifice to an elevation above that of the dispensing unit. The user simply grasps the exposed portion of the hair foil, without the necessity of inserting fingers through the dispensing orifice. Each hair foil has a lead portion that passes through the dispensing orifice, and a trailing portion that later passes through the dispensing orifice. A trailing portion of a first hair foil to be dispensed overlaps the leading portion of the next hair foil to be dispensed. The overlap is usually, but not necessarily, the same for each hair foil and constant throughout the width of each hair foil. As the user withdraws the first sheet of hair foil, the leading portion of the next sheet of hair foil is pulled through the orifice for later dispensing.

The sequential withdrawal of the succeeding hair foil through the dispensing orifice occurs due to the interfolding of adjacent sheets of hair foil. The sheets of hair foil are folded against one another in a variety of configurations, so that the friction of the trailing portion of the withdrawn sheet against the succeeding sheet pulls the leading portion of the succeeding sheet through the dispensing orifice. The user can then apply the hair foil to the hair.

What is claimed is:

1. A system for dispensing hair foil sheets comprising:

a pop up/out dispenser;

interfolded sheets placed in said dispenser; and said interfolded sheets having a width ranging from about 3.5 to 6.0 inches.

2. The hair foil sheet of claim 1 wherein said sheet can be any color foil.

3. The hair foil sheet of claim 1 wherein said sheet comprises any and all types of alloy.

4. The hair foil sheet of claim 1 having a weight or gauge ranging from about 0.00035 to 0.001 inches in thickness.

5. The hair foil sheet of claim 1 wherein said weight or gauge ranges from about 0.005–0.007 inches in thickness.

6. The hair foil sheet of claim 1 wherein said sheet is embossed.

7. The hair foil sheet of claim 1 wherein said sheet is non-embossed.

* * * * *